United States Patent [19]

Beery

[11] 4,255,061

[45] Mar. 10, 1981

[54] CONTROL CIRCUITRY FOR ACTUATION OF A RIBBONLESS ENDORSER FOR PRINTING VARIABLE INFORMATION ONTO MOVING DOCUMENTS

[75] Inventor: Jack Beery, Farmington, Mich.

[73] Assignee: Burroughs Corporation, Detroit, Mich.

[21] Appl. No.: 16,044

[22] Filed: Feb. 28, 1979

Related U.S. Application Data

[63] Continuation of Ser. No. 789,924, Apr. 22, 1977, abandoned.

[51] Int. Cl.[3] ..... B41J 3/12

[52] U.S. Cl. ..... 400/124; 101/93.05

[58] Field of Search ..... 101/91, 93.04, 93.05, 101/235, 245; 178/30; 400/124, 121

[56] References Cited

U.S. PATENT DOCUMENTS

| | | | |
|---|---|---|---|
| 3,703,949 | 11/1972 | Howard et al. | 400/124 |
| 3,795,298 | 3/1974 | Kodis | 400/124 |
| 3,803,628 | 4/1974 | Van Brimer et al. | 346/1 |
| 3,844,395 | 10/1974 | Mero et al. | 400/124 X |
| 3,922,965 | 12/1975 | Platt | 101/93.04 |
| 3,942,620 | 3/1976 | Dillinger et al. | 101/93.05 X |
| 3,990,559 | 11/1976 | Martin et al. | 400/124 |

*Primary Examiner*—Paul T. Sewell

*Attorney, Agent, or Firm*—David G. Rasmussen; James E. Ledbetter; Kevin R. Peterson

[57] ABSTRACT

A control circuitry for operation of a matrix wire printer for impacting a continuously inked rotating platen for printing variable information onto transported documents moving between the printer and the platen. The platen carries a velocity control element for rotative cooperation with a bias roller to initially intercept and decelerate the document to a proper print speed prior to print initiation. Document position is transduced into a plurality of logic signals for commanding the individual actuation of successive columnar prints by the pin printer for printing a preselected message as stored in memory.

6 Claims, 17 Drawing Figures

NORMAL SPEED
PRINT CLOCK STROBES

CONTROL CIRCUITRY FOR ACTUATION OF A RIBBONLESS ENDORSER FOR PRINTING VARIABLE INFORMATION ONTO MOVING DOCUMENTS

This is a continuation of application Ser. No. 789,924, filed Apr. 22, 1977, abandoned.

CROSS REFERENCE TO RELATED APPLICATIONS

The control circuitry of the present invention may be utilized, for example, in the Ribbonless Endorser as disclosed in U.S. patent application, Ser. No. 650,707, filed Jan. 20, 1976, by Jack Beery, which application is assigned to the assignee of the present invention, and which application is incorporated herein by reference.

The control circuitry of the present invention may be also embodied, for example, in the Ribbonless Endorser as disclosed in U.S. patent application, Ser. No. 684,449, filed May 7, 1976, by Jack Beery which application is assigned to the assignee of the present application, and which application is incorporated herein by reference.

Also, the ribbonless endorser of the present invention may be used, for example, in the Modular Document Encoder shown in U.S. Ser. No. 574,722, filed on May 5, 1975 by R. Clayton and R. Schade, and in association with structures and devices disclosed in the following related U.S. patent applications, said applications all being assigned to the assignee of the present invention:

U.S. Ser. No. 642,061, filed Dec. 18, 1975, by K. Christou and K. Kruklitis entitled "A Straight Line Read System";

U.S. Ser. No. 573,787, filed May 1, 1975, by W. Templeton entitled "Method And Apparatus For Identifying Characters Printed On A Document Which Cannot Be Machine Read";

U.S. Ser. No. 609,222, filed Sept. 2, 1975, by H. Wallace entitled "Document View Station";

U.S. Ser. No. 608,567, filed Aug. 28, 1975, by W. Templeton entitled "Method And Apparatus For Driving A Document Through An Encoder Station";

U.S. Ser. No. 591,856, filed June 30, 1975, by J. Neri and J. Williams entitled "Ink Transfer Member";

U.S. Ser. No. 650,707 filed Jan. 20, 1976 by J. Beery entitled "Controls For A Ribbonless Programmable Endorser";

U.S. Pat. No. 650,723 filed Jan. 20, 1976 by J. Beery entitled "Improved Pin Printer Life Utilizing Pin Shifting";

U.S. Ser. No. 643,366 filed Dec. 22, 1975 by J. Beery entitled "Optical Tachometer Using An Apertured Collimating Device";

U.S. Ser. No. 773,007 filed Feb. 8, 1977 by J. Haas entitled "Dot Printer Delay Correction By Line Frequency Synchronization"; and U.S. Ser. No. 654,080 filed Feb. 2, 1976 by K. Helwig entitled "Bi-directional Printer For Front And Rear Endorsement Of Documents".

BACKGROUND OF THE INVENTION

1. Field of the Invention

The invention relates to printers and endorsers, and more particularly to electrical circuitry for controlling a dot matrix printer for printing variable information onto a moving document.

2. Description of the Prior Art

Known endorsers for printing information either on the front or rear sides of documents have generally provided for the printing of fixed and constant information by means of a rotating ledgend-carrying print head which serves to impress an ink ribbon into contact with the document. Variable information endorsers, however, are complex in structure often taking the form of ink jet printers wherein uniformly sized droplets of ink are pressureably ejected from a nozzle and variably deflected electrostaticly or magnetically in free flight toward the moving document to form individual characters of the variable information desired to be printed.

Such prior art variable information endorsers, although appropriate for use in large scaled document processing equipment, have generally proven to be too expensive for use in smaller scale, low cost, special purpose equipment such as document encoders, the primary objective of such special purpose equipment being the preliminary encoding and sorting of documents preparatory to automatic processing.

SUMMARY OF THE INVENTION

It is accordingly an object of the present invention to provide a low cost and reliable document endorser that is effective for printing variable information onto documents as the same are transported at a control speed along a document transport path.

It is yet another object of the present invention to utilize a wire matrix printer for printing variable information onto moving documents by utilizing a rotatable curvilinear print platen in conjunction therewith.

It is yet another object of the present invention to provide printing signals commanding actuation of the matrix pin printer originating from the rotatable curvilinear platen rotating in conjunction with the position of the moving document.

It is still a further object of the present invention to compensate for rotational speed variants of the platen driving motor during print control actuation.

It is yet another object of the present invention to insure a predetermined time of pin actuation of selected print solenoids irrespective of the frequency of print commands.

It is yet another object of the present invention to store print commands when the same are not useable due to present print solenoid hammer actuation.

It is yet another object of the present invention to compensate for accumulation of stored print command signals by extinguishing the same at the end of the print cycle between printed characters.

The objects and purposes of the invention are achieved by generation of individual signal commands for commanding successive single prints by a printer to form an endorsement message as stored in memory. The signal commands command a predetermined time of printing wherein individual signal commands are delayable where the immediately prior print is uncompleted, and any delaying of printing is recovered within spacing between printed characters where no printing is to occur. The signal commands further command stored message transfer to the printer in quantums of print selection.

Where a rotatable curvilinear platen is utilized in conjunction with the printer, the signal commands control initiations and termination of platen rotation at proper times.

Other objects features and advantages of the invention will be readily apparent from the following description of the preferred embodiment taken in conjunction with the appended claims, and accompanying drawings.

DESCRIPTION OF THE PREFERRED EMBODIMENT

Figure 1:
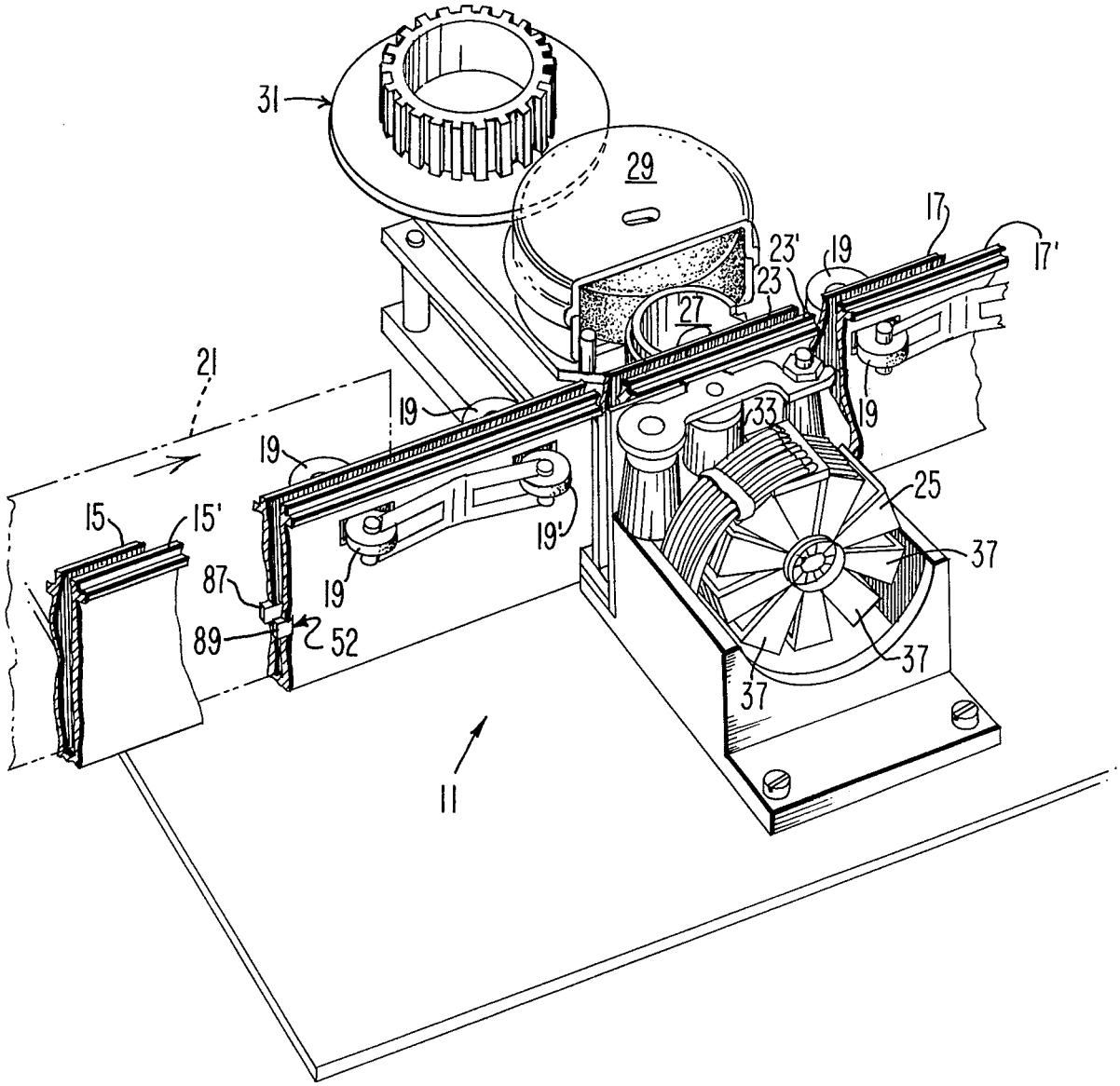
FIG. 1 is a perspective view of an endorser station housing a ribbonless endorser set in relationship to upstream and downstream sections of a document transport path.

The endorser of the present invention records variable information onto a single side of a document as the document travels along a document pathway. The basic environment of the endorser is presented in FIG. 1 illustrating an endorsing station generally designated at 11, a base plate 13, a pair of upstream path defining walls 15, 15', a pair of downstream path defining walls 17, 17', and pairs of drive rollers 19, 19' operably disposed along the upstream and downstream path defining walls for transferring documents at a predetermined transport speed in the direction of the arrows 21.

Intermediate the paths defining walls 15, 15' and 17, 17', are a pair of path defining walls 23, 23' defining the transport path in the area of the endorser station 11. In the endorser station area, the documents may be transported at a controlled reduced speed to permit variable information to be endorsably printed onto the documents. Thus, a document may be transported along the document transport path at a relatively high transport speed in the upstream pathway 15, 15', decelerated to a controlled slower endorser speed in the endorser pathway 23, 23', and then reaccelerated to a relatively high transport speed in the downstream pathway 17, 17'.

A wire matrix printer generally designated at 25 is located in the endorser area for cooperation with a rotatable curvilinear platen 27 to perform the variable print endorsement. An ink transfer member 29 is maintained in minimal frictional contact with the rotating platen 27 by a biasing device 31 for insuring sufficient ink transfer to continuously ink the platen 27, as described in the above-referenced applications U.S. Ser. Nos. 684,499, 650,707 and 591,856.

The matrix pin printer 25 is comprised of nine vertically arranged pins for printing the desired variable information onto the documents by selectively energizing certain of nine radially pin activating solenoids 37. Preferably, only seven of the nine radially arranged solenoids 37 need be utilized for printing of the desired variable information, as will be described hereinafter.

Figure 2:
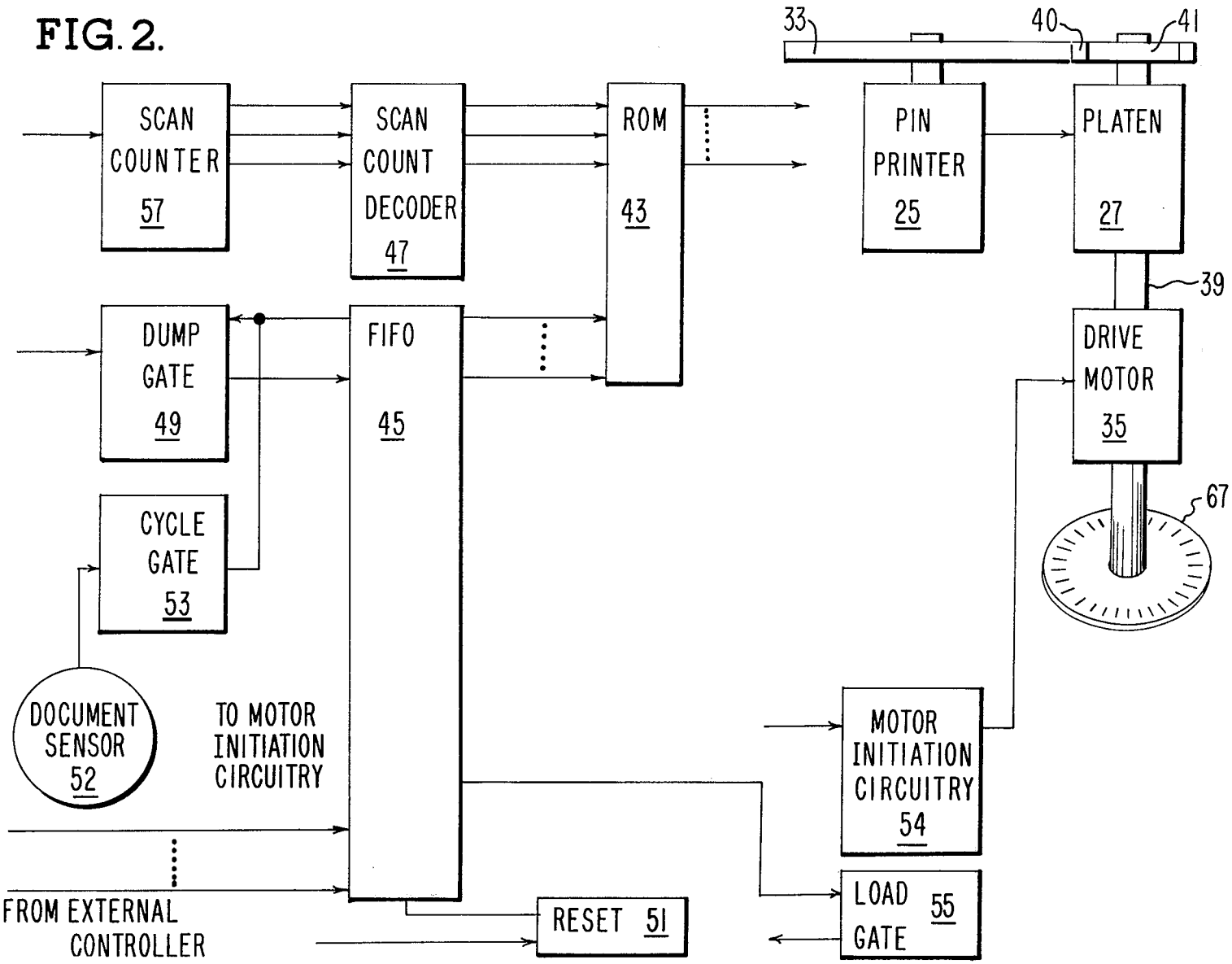
FIG. 2 is a block diagram of a variable endorsement message loading system of the present invention.

The rotational platen 27, as shown in FIG. 2, is mounted on a rotatable shaft 39 for rotation by a drive motor 35, either directly or through the coupling of spur gears or the like, for rotation of the platen at a controlled speed during each endorsing cycle. A velocity control element 41 is secured to the shaft 39 for use to intercept a document moving at a high transport speed along the pathway for decelerating the document to a lower controlled velocity as the document moves past the matrix pin printer 25. A bias roller 33 is situated pathside opposite the control element 41 for rotative cooperation therewith for gripping the document to control its transport speed through the endorser station 11 of FIG. 1.

As described in the referenced application U.S. Ser. No. 650,707, the velocity control element 41 includes an outer document engageable peripheral area 40 which pinches with the bias roller 33 only at certain times during its single rotation. The peripheral area 40 and the bias roller 33 are not in pinching engagement initially and the drive motor 35 must be rotated to bring the peripheral area 40 into engagement with the bias roller 33 for pinching a document therebetween to decelerate the same to the controlled speed of the rotating platen 27.

The matrix printer 25 is controlled by a read only memory (ROM) 43 for endorsing the document with preselected stored information. The pins of the printer 25 are arrayed in a column, and the output of the ROM 43 dictates appropriate pins to be actuated as the document travels past the print station. The ROM 43 is preprogrammed for producing seven consecutive output signals corresponding to a particular character font when addressed by a character address from a first-in-first-out memory (FIFO) 45.

The FIFO 45 is orderly stored with character addresses to compose the desired message endorsement as chosen by the operator. The ROM is thus initially addressed from the FIFO 45 by a seven-bit character address which selects the character to be printed. A three-bit special pattern address from a decoder 47 changes seven times for each character addressed by the FIFO for selecting the individual columns of dots that make up the addressed character. After the special pattern address has counted through its seven special addresses, the character address from the FIFO 45 is changed for the printing of a subsequent character.

The decoder 47 is actuated by a four-bit counter 57 operable for counting to ten and then resetting itself. Bits 1, 2, and 3 are decoded for ROM scanning to produce the seven columns of dots to print the character addressed by the FIFO, while bit four is used to idicate that the counter is on the last three counts. The last three counts are used to provide spacing between characters when no printing is permitted.

The FIFO memory storage 45 is serially loaded from an external controller (not shown) with data designating the desired endorsement message. A dump gate 49 is provided to serially dump the character addresses from the FIFO, serially addressing the ROM as each new character address is needed. A FIFO reset 51 is provided to reset the FIFO initializing it to receive a message endorsement data block from the external controller when the apparatus is initially turned on, or at the end of a document endorsement. Load gate 55 provides communication with the external controller that the FIFO has been reset and is ready to accept a subsequent block of message data from the external controller.

A document sensor 52 is positioned upstream of the endorsing station for sensing the trailing edge of a moving document for automatic initiation of the platen drive motor 35 to begin the endorsement printing. In the event that the FIFO 45 has not yet received a data message block, a cycle gate 53 prevents the document sensor 52 from communicating with a drive motor initiation circuitry 54. The cycle gate 53 determines if the FIFO has been reset and if new data has been fed into the FIFO from the external controller, and then permits the document sensor 52 to communicate with the motor initiation circuitry 54 accordingly.

IF the FIFO 45 is loaded with data from the external controller, the endorser motor 35 is activated upon the sensing of the trailing edge of a document moving toward the endorsing station. The motor initiation circuitry 54 rotates the velocity control element 41 moving the peripheral area 40 into cooperation with the moving document to engage the document between the bias roller 33 and velocity control element 41 for decelerating the document to a slower speed to begin document endorsing. By sensing the trailing edge of the document, the apparatus insures that the document has cleared its previous operational station and is now traveling at a uniform speed to be engaged by the velocity control element 41.

As will be obvious to a person skilled in the art, an ink stamp carried by the platen could function as the decelerating element 40, and a projecting portion could be utilized to engage the moving document prior to engagement by the ink stamp to prevent ink smear from the stamp, as disclosed in the above-referenced application Ser. No. 650,707.

If the FIFO 45 has not been loaded, motor 35 is not energized through the cycle gate 53 and the velocity control element is not interposed in the guideway and thus the document travels through the guideway past the print station unimpeded.

A timing disk 67 is coupled to the drive motor 35 for rotational movement in cooperation with the rotational print platen 27. The rotational timing disk 67, as shown in more detail in FIG. 3, carries a plurality of informational components generally designated by numeral 69 disposed in a particular spacing relationship on the surface of the disk. The informational components 69 are utilized to provide control signals for commanding print-pin firings and character spacing at proper timing with respect to the position of the rotating platen, and also are utilized to control the stopping of the platen motor 35 in a fixed "HOME" position at the completion of the document endorsement.

Figure 3:
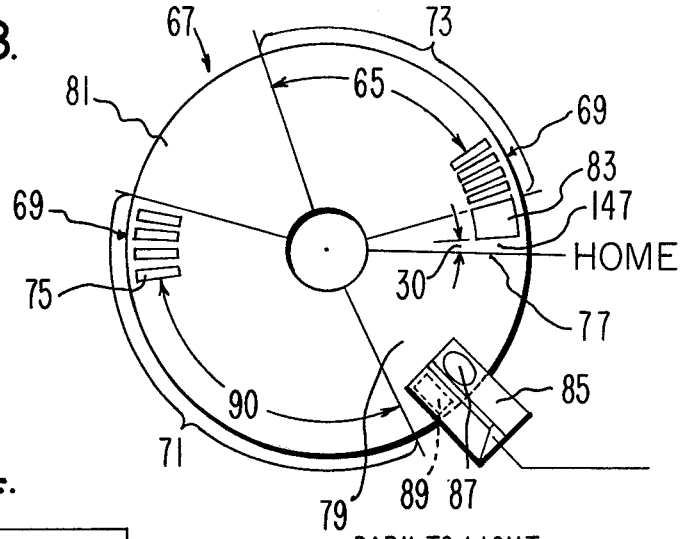
FIG. 3 shows a detailed view of a timing command disk of the present invention.

The disk 67 of the particular embodiment of FIG. 3, carrys informational components grouped in two sets 71, 73 with each set disposed in a separate sector of the disk for covering a sector area equal to the extent of platen rotation required for a separate endorsement by the printer 25.

The informational components are formed from slots or openings 75 communicating the opposite faces of the disk. Each slot 75 is approximately 0.009 inches in radial width and spaced 0.009 inches between adjacent slots. The radial edges defining each slot, both leading and trailing, are utilized to provide timing command signals to initiate pin firings and character spacing. Thus, each slot may be generally recognized to command two command signals.

The two sets of information slots are arranged on the disk with respect to a radial "HOME" line 77. The HOME line 77 is used as a reference location as the position at which to begin sensing for information slots as the platen motor 35 is initiated at the start of each endorsement cycle.

Initially, the disk is rotated from its HOME position 77 through an unslotted sector 79 of the disk during which a document is engaged by the velocity control element 41 and brought to a controlled speed before stamp or pin printing is initiated. The two sets 71, 73 of print command slots may be separated by an unslotted sector 81 of the disk for providing spacing between the two endorsements which are to be printed, or allowing a fixed information endorsing-face carried by the platen to be impacted against the document, and thus requiring no pin firings. As will suggest itself to persons skilled in the art, the number of sets of informational sectors commanding printing and the degree of spacing established therebetween may be chosen according to the needs of the particular system.

In order to accurately stop the rotating platen at a predetermined registration upon completion of document endorsement, a slot 83 having a rotational width larger than the print commanding slots 75 is positioned in a particular relationship on the disk with respect to the HOME line 77.

Figure 4:
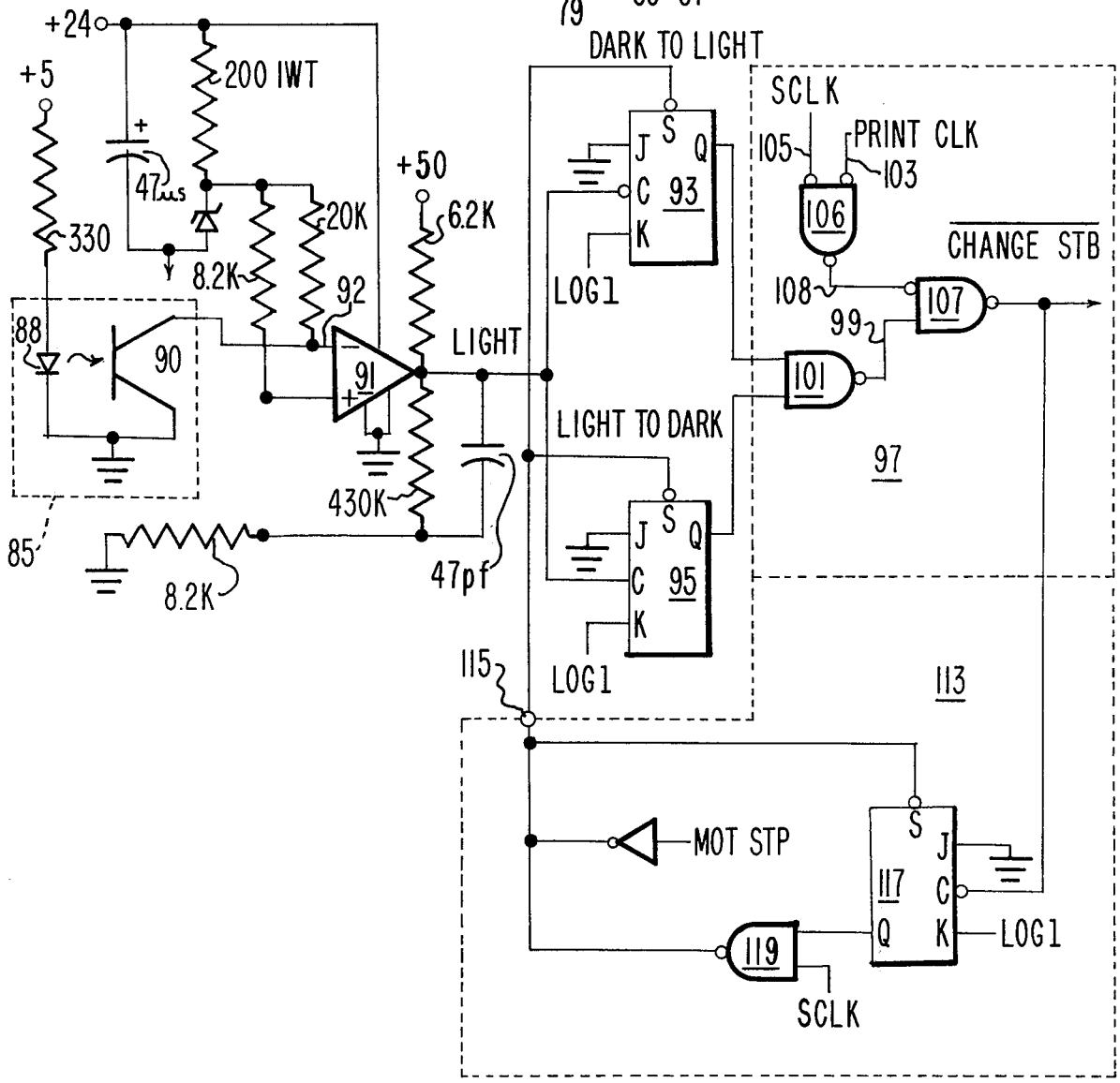
FIG. 4 shows a schematic electrical diagram of a timing signal command transducing and storing system of the present invention.

A sensing member 85 is set in a cooperative relationship with the disk 67 for sensing the informational components 69 as the disk is rotated. The sensing member 85 includes a light source 87 and a photosensing member 89 disposed about either side of the disk 67. The photosensing member 89 is enabled as the rotating disk permits the light source 87 to pass light through the moving slots to impinge upon the photosensing member 89. As shown in FIG. 4, the light source may, for example, include an LED 88 and the photosensing member may include a phototransistor 90.

As will suggest itself to those skilled in the art, other components and sensing devices may be utilized to generate commands by placing other types of information, e.g., magnetic, mechanical, electrical, optical, and the like, onto a rotating disk with a sensor positioned in sensing relationship therewith for sensing the rotating information for providing commands occurring in a timed relationship with the rotational position of a platen which is rotating in relation to the disk.

As will further suggest itself to those skilled in the art, the disclosed command generator may take other forms in the novel combination disclosed, which forms may or may not transduce document position, as for example, a clock generator triggered by the document sensor 52. However, the particular use of the herein disclosed command generator provides novel features to the combination as will be apparent from the following description.

Referring to FIG. 4 the phototransistor 90 of the sensing member 85 produces a voltage output which is fed to a voltage comparator 91 for conversion to useable logic level signals. The comparator 91 has an input 92 which is controlled by the phototransistor 90. As the phototransistor's output swings above or below seven volts, the comparator's output changes. Thus, the sensing of the leading and trailing edge of each slot 75 and slot 83 of the disk produces a comparator output transition. The comparator output during sensing of a slot 75, 83 is denominated "LIGHT".

The comparator output is fed to a pair of flip-flops 93 and 95. The flip-flop 93 is set by a dark-to-light transition of the disk (the sensing of the leading edge of the slot), while flip-flop 95 is set by a light-to-dark transition (the sensing of the trailing edge of the slot). The two flip-flops 93, 95 serve as storage devices for storing a command signal until other control circuitry can utilize the command signals as described hereinafter.

Figure 5A:
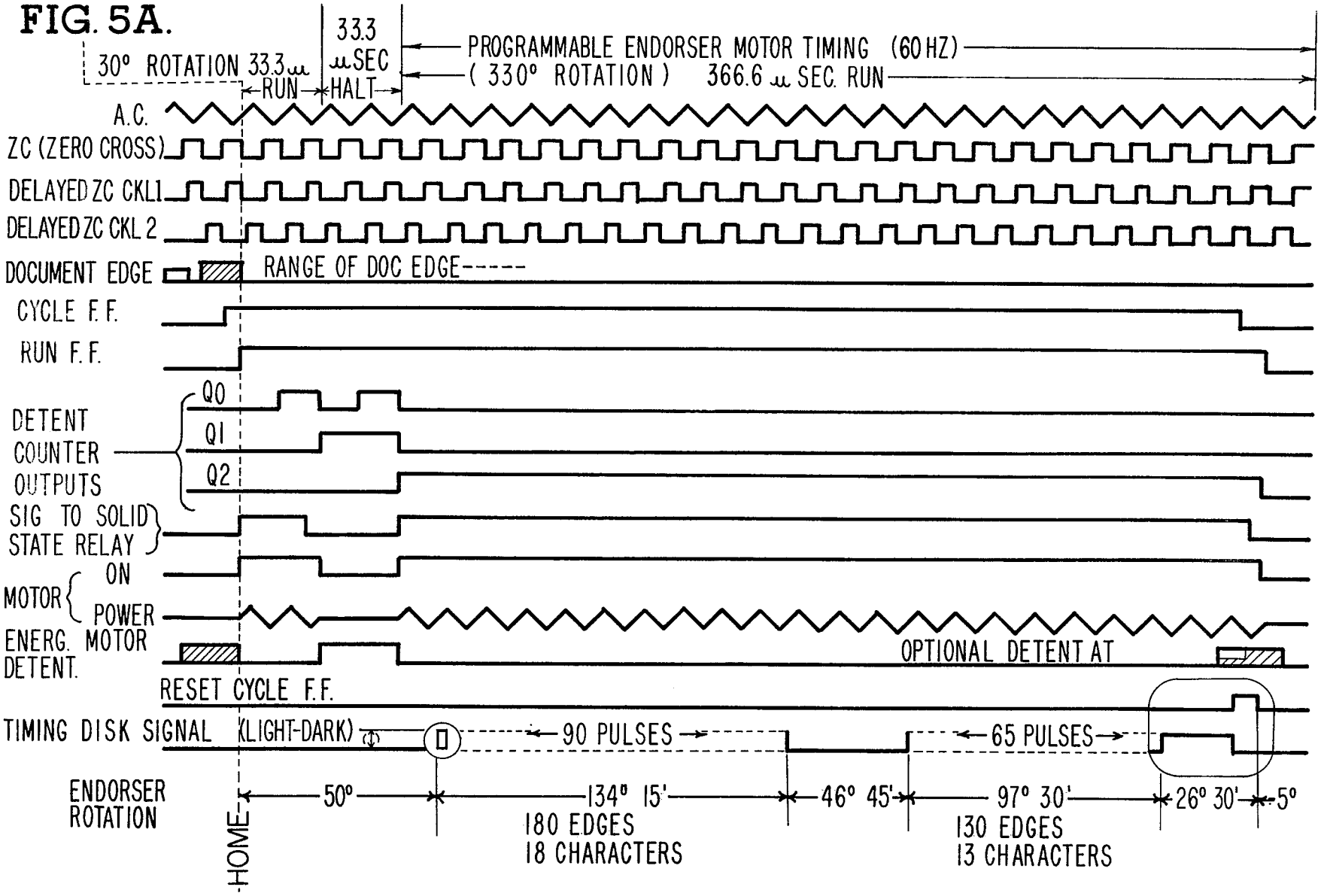
FIGS. 5A–F show signal waveform timing diagrams of waveforms of the present invention.
Figure 5B:
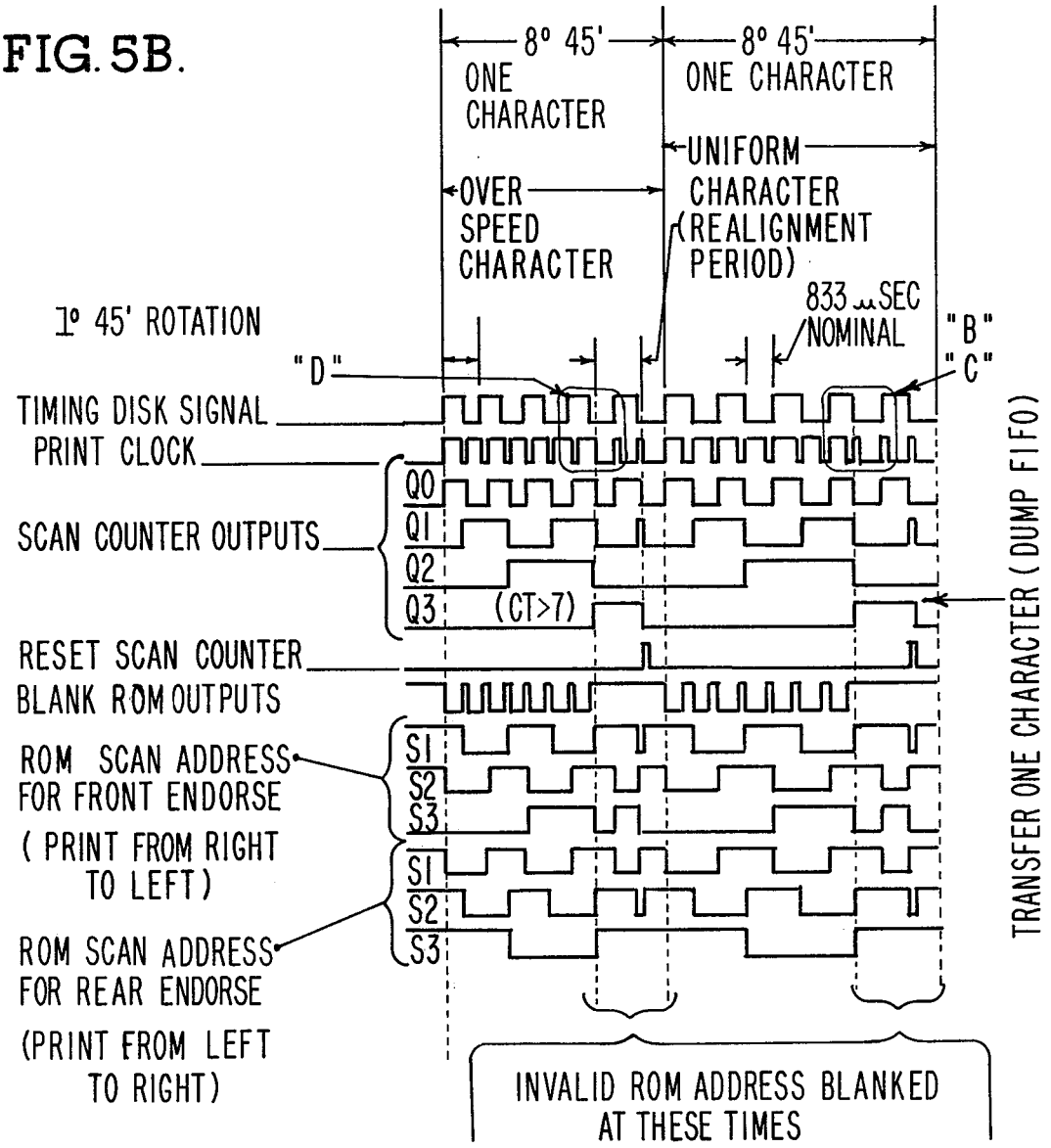
Figure 5C:
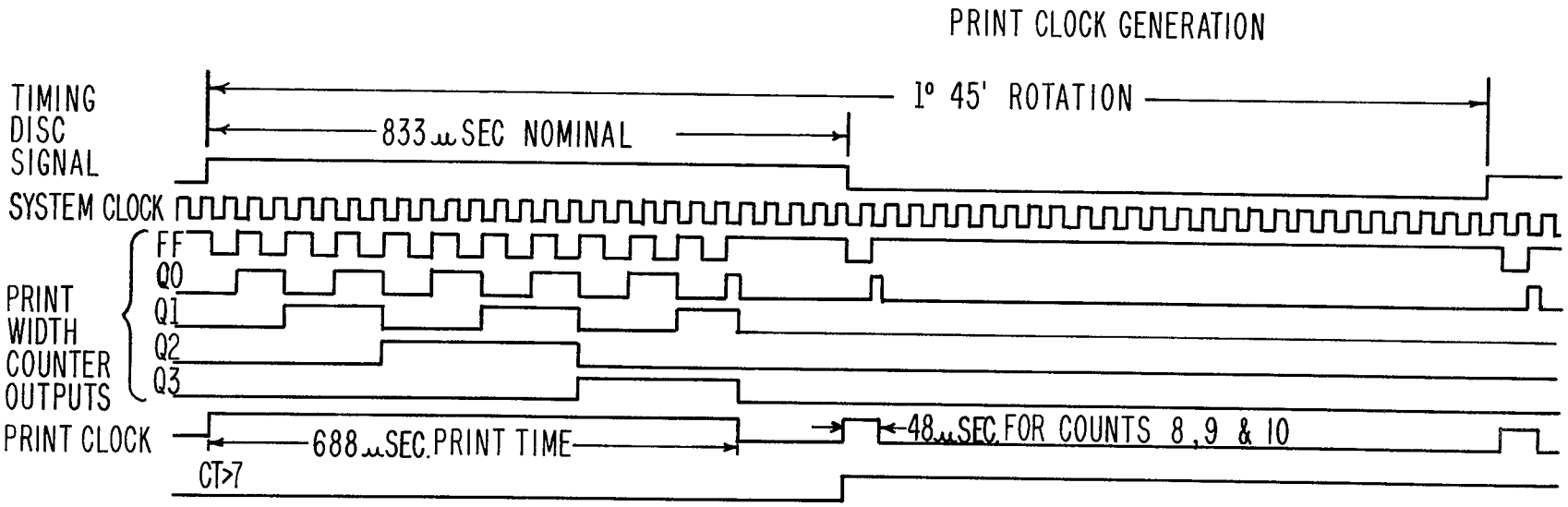
Figure 5D:
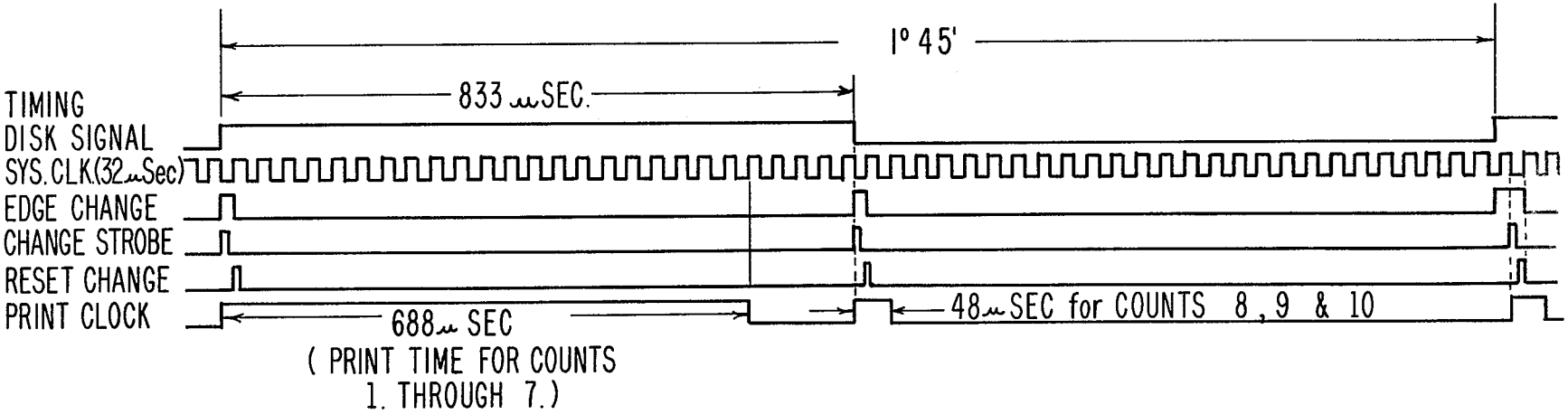

Referring to FIG. 5D a TIMING DISC SIGNAL (which is the output of the comparator 91) is shown having pulses lasting 833 microseconds corresponding to each sensed informational slot 75. The flip-flop 93 is set on the leading edge of these timing disk signal pulses while the flip-flop 95 is set on the trailing edge, as illustrated in FIG. 5D by an EDGE CHANGE signal.

Referring again to FIG. 4, the stored command signals of flip-flops 93, 95 are fed to a logic circuitry 97 for production of a pulse output signal called CHANGE STROBE which is utilized to produce a solenoid energization signal of a fixed duration for actuating the pins of the printer as selected by the ROM 43. The CHANGE STROBE signal is produced only when the system circuitry is prepared for receiving print commands.

The circuitry 97 receives the outputs of the flip-flops 93, 95 for producing a signal at 99 via NAND gate 101 indicative of whether a print command is stored in one of the flip-flops 93, 95. The circuitry 97 also receives a PRINT CLOCK signal input and a SYSTEM CLOCK signal input at the input nodes 103, 105 of a NAND gate 106 producing an output at 108, The output at 108 and the stored print command are joined via NAND gate 107 for producing the CHANGE STROBE signal.

The PRINT CLOCK signal is the energization signal applied to the solenoids of the pin printer and thus indicative of whether or not a printing of solenoid hammers is occurring. The PRINT CLOCK signal'effect on NAND gate 107 is to provide a CHANGE STROBE signal only when no solenoids are being energized.

The SYSTEM CLOCK signal is directly related to the PRINT CLOCK signal, as described hereinafter, and thus the SYSTEM CLOCK signal's effect on NAND gate 107 assures the CHANGE STROBE will not occur until at least 16 microseconds after the preceeding solenoid print has been completed. This provides a minimum off-time between immediate pin energizations, and provides a housekeeping function of the system signals.

Figure 5E:
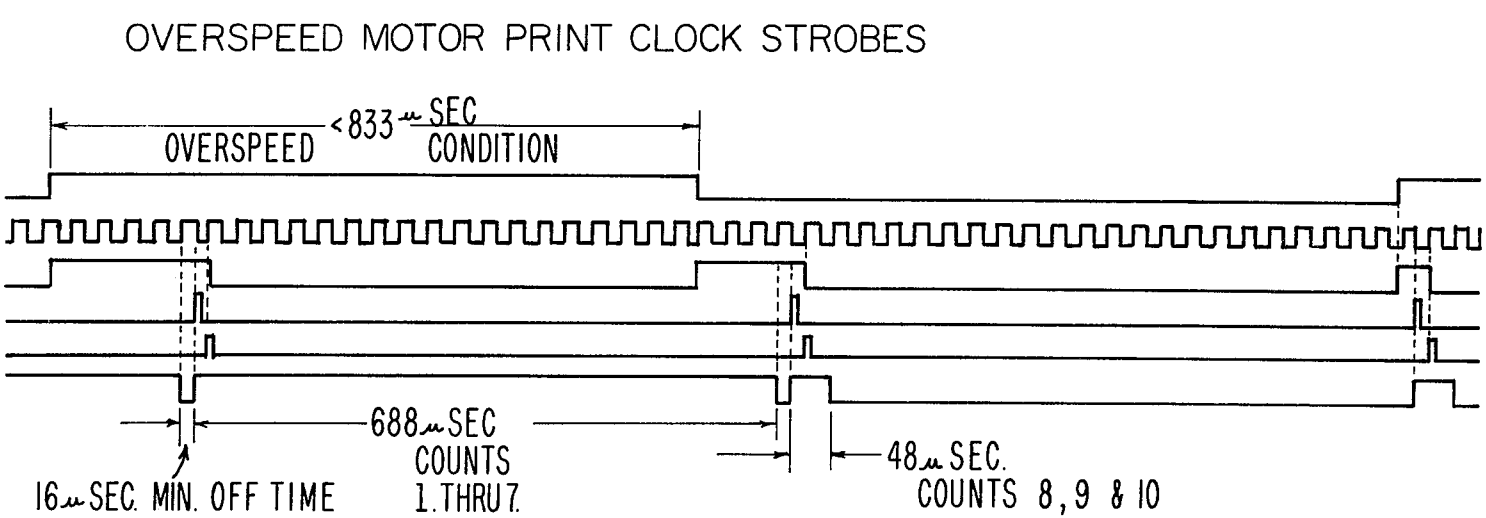

Referring to FIG. 5E, the SYSTEM CLOCK signal is indicated by a plurality of clock pulses. The CHANGE STROBE signal is shown as a pulse output occurring in cooperation with the SYSTEM CLOCK signal, EDGE CHANGE signal and PRINT CLOCK signal such that the CHANGE STROBE occurs a minimum of 16 microseconds after the EDGE CHANGE signal is high and the PRINT CLOCK is low. Because the PRINT CLOCK signal is generated by the CHANGE STROBE signal, the CHANGE STROBE signal is extinguished quickly after its production. Thus, the CHANGE STROBE signal is a pulse signal initiated by the timing disc but set in phase with the SYSTEM CLOCK signal and occurring only when the print hammers are not in possible operation. The CHANGE STROBE is thus illustrated in FIG. 5D and 5E as a pulse output occurring on the trailing edge of the SYSTEM CLOCK pulse signal.

The CHANGE STROBE signal is fed to a reset change flip-flop circuitry 113 of FIG. 4 which is utilized to reset the flip-flops 93, 95 after the stored print command of the flip-flops has been utilized to produce the CHANGE STROBE signal. The output node 115 of the reset circuitry 113 feeds the flip-flops 93, 95 for resetting the same. The reset circuitry 113 includes a flip-flop 117 for receiving the input of the CHANGE STROBE signal for storing the same. The SYSTEM CLOCK signal is fed in cooperation with the output of the flip-flop 117 via a NAND gate 119 to produce a RESET CHANGE signal at node 115 occurring 16 microseconds after the CHANGE STROBE signal has been produced. The RESET CHANGE signal resets flip-flop 117. With both change flip-flops reset, NAND gate 101 of the circuitry 97 produces a low logic output at 99 keeping the CHANGE STROBE signal extinguished in the event that the PRINT CLOCK signal goes low before the next command signal is produced.

A MOTOR STOP signal indicative of the drive motor 35 being off is ORed together with the reset line of output node 115 of the reset circuitry 113 for resetting the flip-flops 93, 95. This disables printing during the period the motor is stopped, so that printing does not occur in the event that the rotational platen is turned by hand when the motor is off.

Referring to FIG. 5D, the RESET CHANGE signal is shown as occurring on the leading edge of the next SYSTEM CLOCK pulse, occurring 16 microseconds after the CHANGE STROBE signal has been generated. Thus, the reset change flip-flop circuitry 113 of FIG. 4 resets the flip-flops 93, 95 on the leading edge of the next SYSTEM CLOCk pulse after the stored command in either of the changed flip-flops 93, 95 has been utilized to provide a print solenoid energization.

Figure 6:
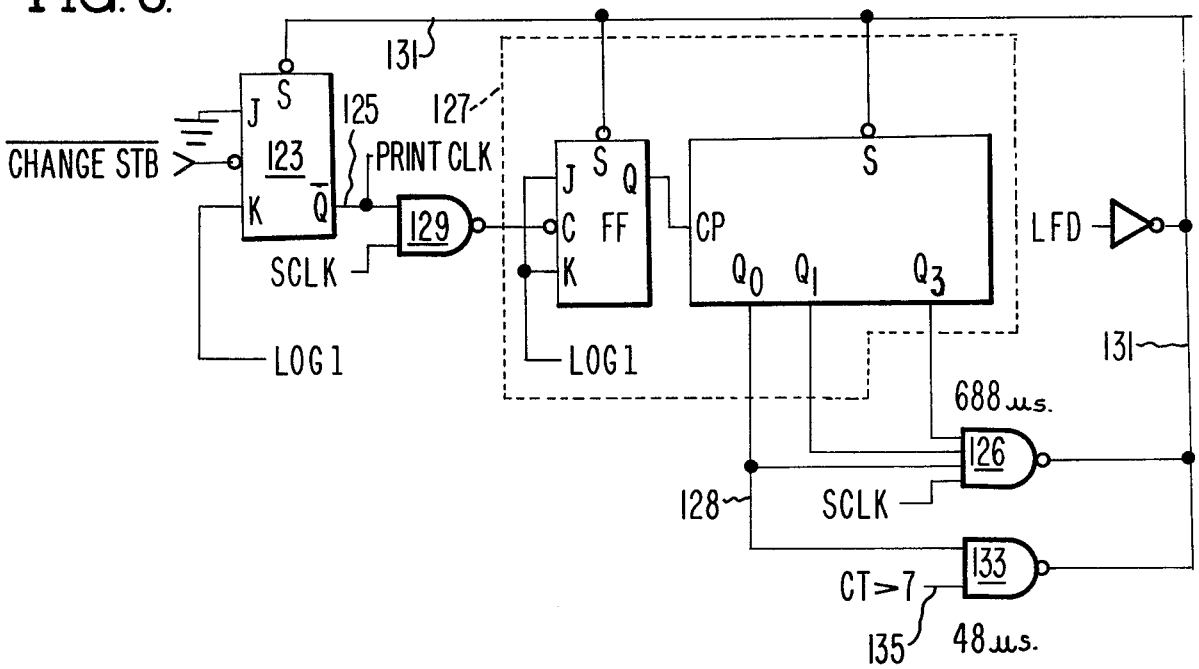
FIG. 6 shows a schematic diagram of a print energization signal width selection system.

Referring to FIG. 6, the CHANGE STROBE signal produced by the logic circuitry 97 of FIG. 4 is utilized to activate a constant output signal source 123. The signal course is a flip-flop 123, pulse-activated by an input of the CHANGE STROBE signal for producing a constant output at node 125. This constant output signal from node 125 is denominated the PRINT CLOCK signal and is used for clocking the pin printer. The width of the PRINT CLOCK signal determines the on-time of the pin printer solenoids.

In order to establish a fixed time of pin activation, a print width counter 127 is utilized to control the on-time of the constant voltage output from flip-flop 123. The print width counter 127 comprises a 5-bit binary counter whose outputs are decoded to determine the width of the PRINT CLOCK signal. When the PRINT CLOCK is high the SYSTEM CLOCK signals are gated into the counter by NAND gate 129 for counting according to the SYSTEM CLOCK. During printing the counter outputs are decoded via NAND gate 126 to reset the constant voltage signal source 123 after 688 microseconds have lapsed. Thus, after a 688 microsecond count a pulse via line 131 is fed to the reset of the flip-flop 123 and to the reset of the counter 127 for extinguishing the PRINT CLOCK signal, thus deactivating the solenoid hammers.

Also, an early count is decoded from the counter 127 along line 128, lasting 48 microseconds. This early count signal is fed to NAND gate 133 in conjunction with a signal occurring on line 135. The signal of line 135 is indicative of the fact of whether or not the last three counts of the scan counter 57 of FIG. 2 are occurring. Thus, a shorter print clock width of the print clock signal is produced during the last three print commands of an individual character, during which only spacing is to occur between printed characters on the document. This shorter print clock width serves to correct for possible error accumulation in the flip-flops 93, 95. The earlier 48 microsecond count signal is also fed onto line 131 for extinguishing the constant voltage signal source 123 and resetting the print width counter 127.

Referring to FIG. 5D, the print clock is illustrated in a 688 microsecond form and also in a 48 microsecond form which occurs during counts 8, 9 and 10 of the print character. Thus, FIG. 6 illustrates apparatus for establishing the energization time of individual print solenoids, and wherein the apparatus shortens the command time of the last several print commands when printing will not occur in order to correct for possible error accumulation in the event of an overspeed motor condition. Thus, where a faster than normal speed of the print platen occurs (as illustrated in FIG. 5E) which causes a demand for printing as the solenoid is in the midst of a print, there will be no response. Each print command is stored and any accumulation thereof is extinguished at the end of the character print cycle between printed characters.

The 48 microsecond pulses are coordinated for occurrence in the spacing between printed characters. Thus, the first 7 actuations form the individual print character and the next character does not begin printing until three actuation times have lapsed. During those three actuation time, corresponding to spacing between characters, error accumulation is "recovered". The 48 microsecond pulse is generated in order to provide proper circuitry bookkeeping, i.e. resetting the print source 123 and print width counter 127 in order to sense incoming print commands, but such incoming print commands may be initiated quickly because the print commands do not have to be stored for a long period with a print width of only 48 microseconds waiting time.

Figure 7:
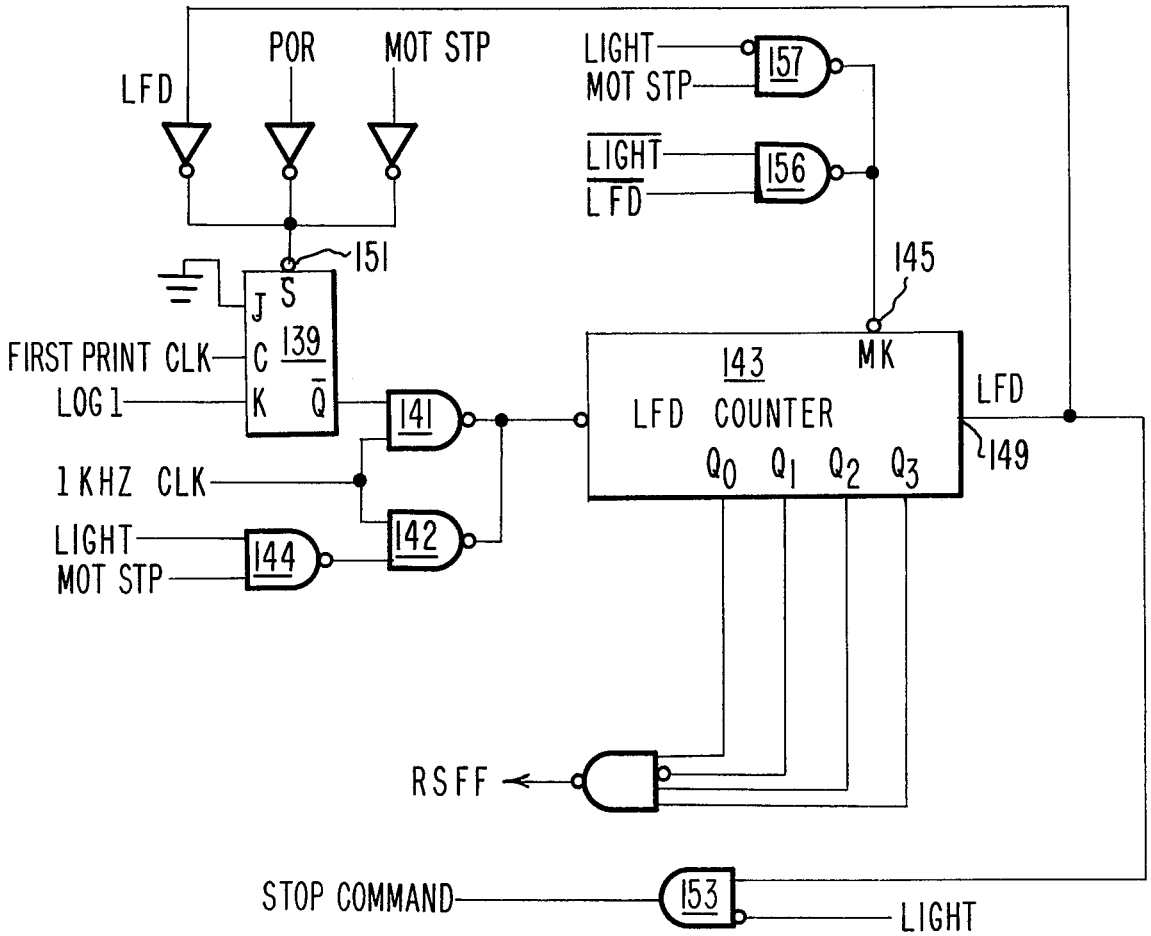
FIG. 7 shows a schematic diagram of a signal system for commanding print platen stopping.

Referring to FIG. 7, circuitry is illustrated which operates in timing coordination with the other circuitry of the system for stopping of the print motor at its proper location for placing the platen 27 in its HOME position, and for resetting the FIFO storage device.

An LFD flip-flop 139 is set by the first PRINT CLOCK signal and remains set for telling the logic system to begin looking for a dark 5° sector 147 which interposes the large light area 83 and the HOME line 77 of the timing disk 67 (shown in FIG. 3). The output of the LFD flip-flop 139 is fed to a NAND gate 141 opening the same to permit a 1 kHz clock signal to be fed to an LFD counter 143 for counting the 1 kHz signal. The light-to-dark transition signal $\overline{(LIGHT)}$ from voltage comparator 91 of FIG. 4, resets and holds the LFD counter reset via NAND gate 156, at counter reset 145, each time the disk sensor 85 senses a "dark" area of the disk 67. Thus, the counter starts counting in each light area and is reset each time the disk passes into the next dark area. Thus, the count on the LFD counter 143 is permitted to go into a large count only as the disk 67 rotates through its large light area 83.

The count of the LFD counter 143 is decoded to produce a pulse output signal, LFD, at 149 after, for example, 15 milliseconds have lapsed from the last dark area encountered to indicate that that disk has encountered the large light area 83. The signal LFD is fed to the reset 151 of the LFD flip-flop 139 to stop the counting by the LFD counter keeping the counter at its present count and maintaining the LFD signal. The constant LFD signal from output node 149 is fed to AND gate 153 for producing a STOP COMMAND signal for stopping the motor 35 upon the disk 67 rotating into the next dark area, the 5° dark sector 147 of the disk 67. This occurrence is signaled to AND gate 153 by the light-to-dark transition signal $\overline{(LIGHT)}$ from the comparator 91. The STOP COMMAND signal from AND gate 153 is fed to the drive motor 35 for stopping the same. The sector width of sector 147 is sized (here 5°) for proper timing to allow the STOP COMMAND signal to be generated and the motor 35 braked to terminate at the HOME line 77.

Figure 5F:
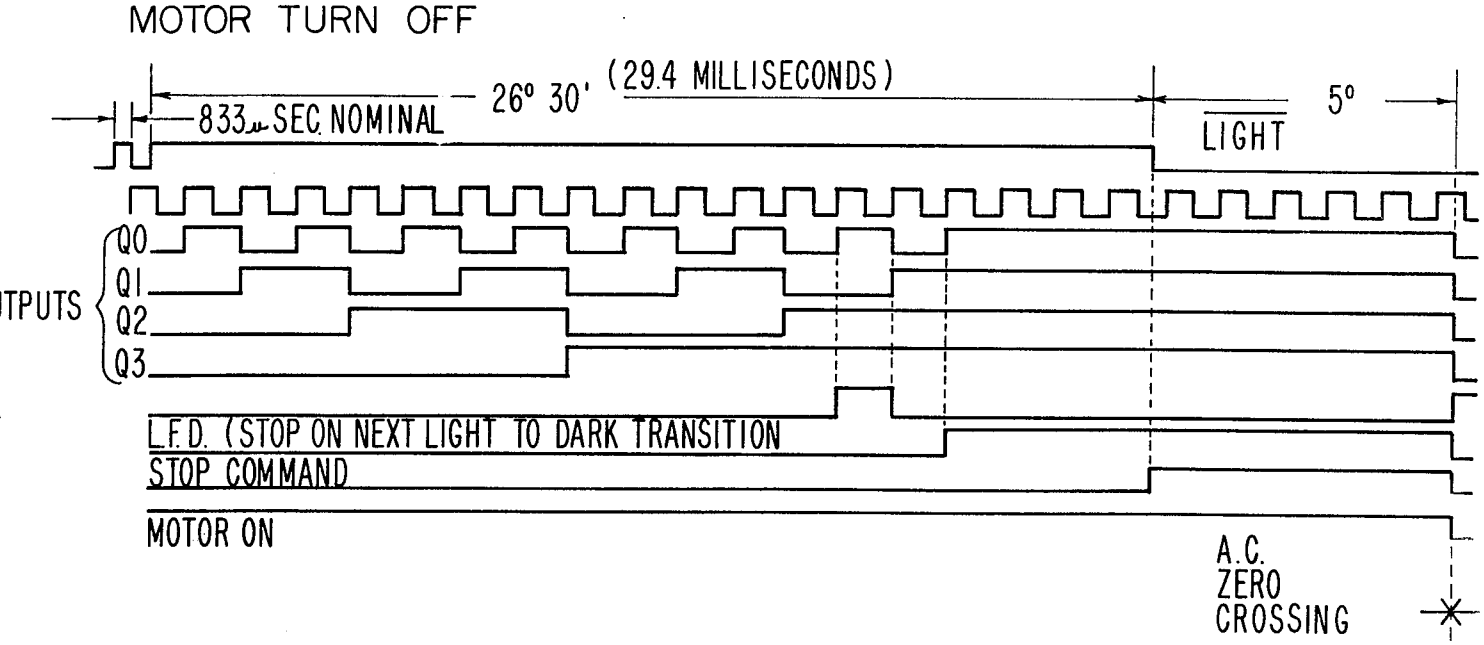

As the motor 35 comes to a complete stop, the MOTOR STOP signal is generated. The MOTOR STOP signal is NANDED with the light-to-dark transition signal $\overline{(LIGHT)}$ via NAND gate 157 for resetting the LFD counter at reset 145. With a resetting of the LFD counter 143, the LFD signal is extinguished which in turn extinguishes the STOP COMMAND signal from AND gate 153, initializing the system for the next entering document. FIG. 5F illustrates the above-described waveforms associated with the LFD counter.

To prevent the motor 35 from stopping in a wrong position in the event that the platen is rotated by hand and left parked with the disk in the light area 83, the LFD signal is generated so that the 5° sector which when immediately encountered upon a subsequent document entrance will cause the drive motor 35 to park in its normal home position. The LFD signal is therefore generated by passing the 1 kilohertz clock signal through NAND gate 142 by opening the same via AND gate 144 in the event that the phototransistor 90 senses a light condition (LIGHT) and the motor is in a stopped condition (MOTOR STOP). The one kilokertz signal loads the counter with all ones producing the LFD signal at output 149. Thus, AND gate 153 will produce the STOP COMMAND signal immediately upon sensing the 5° dark sector 147.

Figure 8:
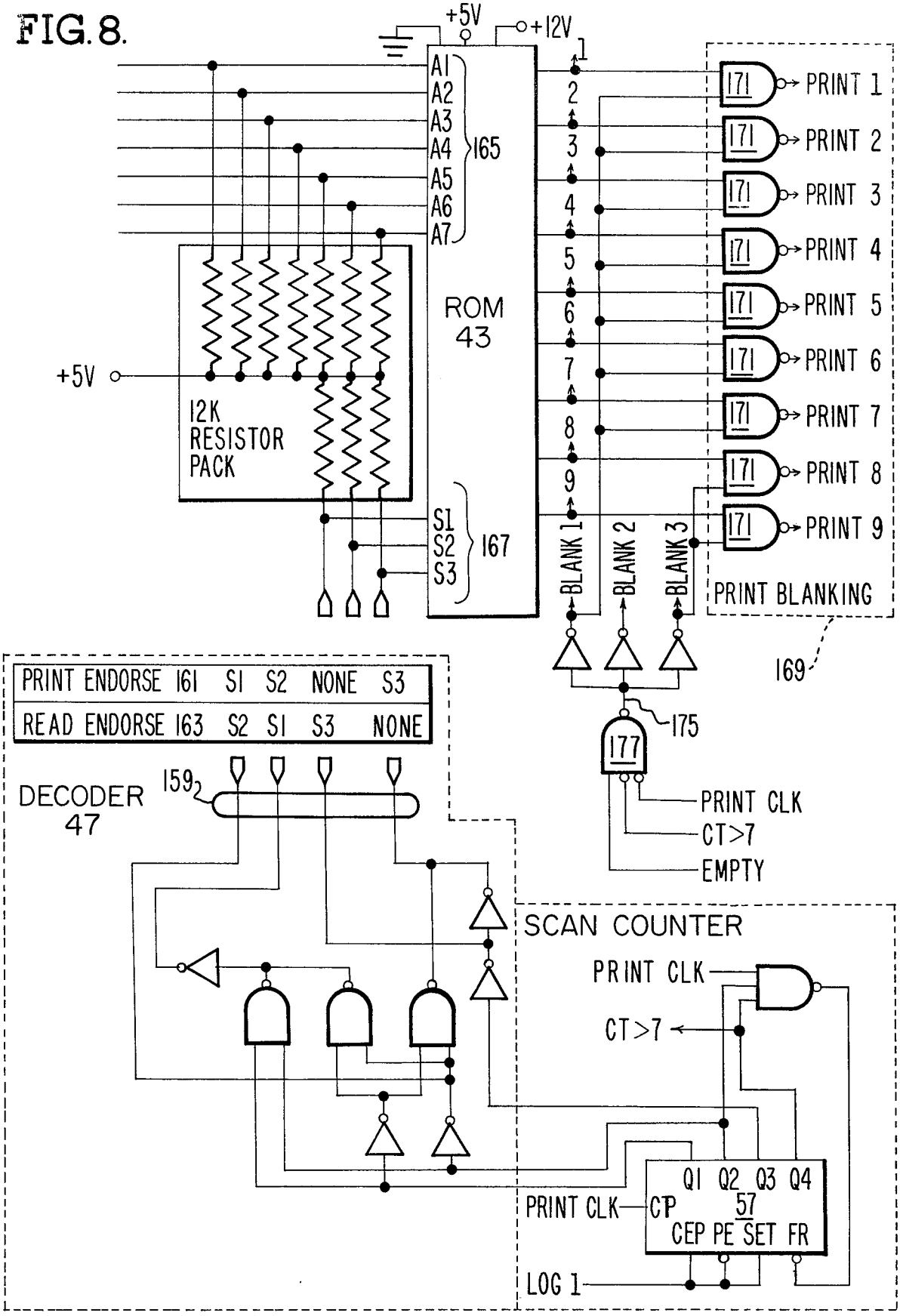
FIGS. 8 and 10 show endorsement message transfer systems.

Referring to FIG. 8, the PRINT CLOCK signal is fed to the scan counter 57 for addressing the ROM 43 to produce the stored print commands, as previously described with respect to FIG. 2. The scan counter 57 is a four-bit counter operable for counting to ten and then resetting itself. Each PRINT CLOCK signal is utilized to increment the counter for consecutively addressing the ROM 43 (see FIG. 5B).

The counter outputs Q1, Q2, and Q3, are fed to the decoder 47 (FIG. 8) which generates a three-bit scan address (S1, S2, S3) for addressing the ROM 43. The decoder operates to produce four outputs generally indicated at 159 from the three-bit output of the counter 57. Two sets 161, 163 of three of the four outputs 159 are formed for selection of either a front endorsement or a rear endorsement scanning pattern onto the document (see FIG. 5B9.

The front or rear endorsement output set 161 or 163 is fed to input 167 (FIG. 8) of the specially programmed read only memory 43 for addressing outputs corresponding to the firing of selected pin printer solenoids. The ROM 43 is first addressed at input 165 by a seven-bit binary address which selects a character to be printed. The endorsement output set from the decoder 47 then changes seven times for selecting the individual columns of dots that make up the character addressed at 165 of the ROM.

The output of the ROM 43 is fed to a print-blanking circuit 169 operable to disable the solenoid firing when desired. The blanking circuit 169 includes nine NAND gates 171 each receiving a respective output from the ROM 43 for gating the ROM output to the pin-printer drivers 173 (FIG. 9) as controlled by a blanking line 175 (FIG. 8) which feeds each NAND gate 171 with the PRINT CLOCK signal. Thus, the solenoid coils 176 (FIG. 9) are energized for the duration of the PRINT CLOCK signal via NAND gates 171 (FIG. 8).

The fourth-bit output Q4 from scan counter 57 (denominated "CT>7") is also fed to the NAND gates 171 via NAND gate 177 for disabling the pin-printer solenoids whenever the character print command is on the eight, ninth, and tenth counts. And EMPTY signal which indicates that the FIFO 45 is empty, may be also passed to gates 171 via NAND gate 177 for disabling the pin printer if fewer than the possible printable characters have been selected by the external controller.

Figure 9:
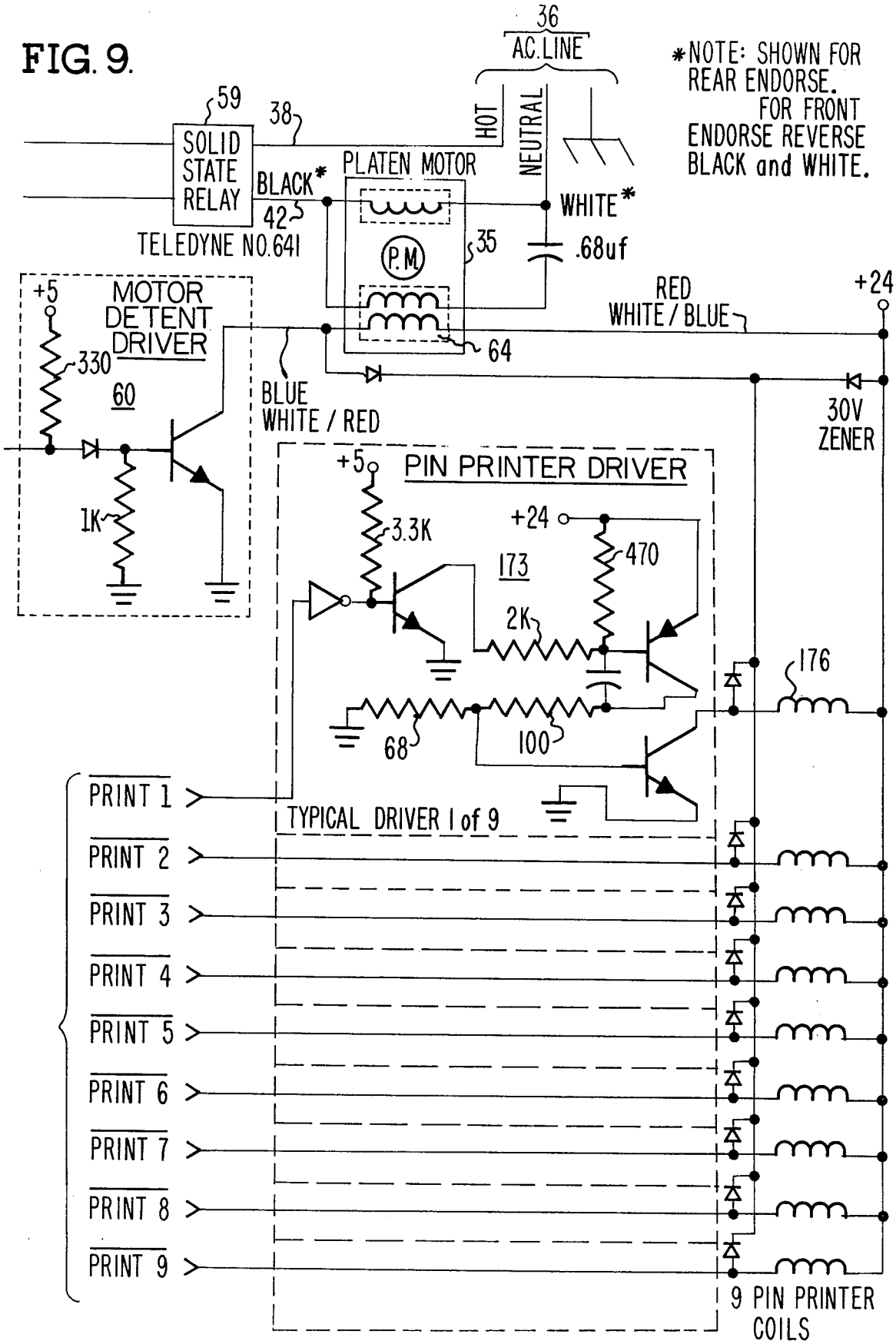
FIGS. 9 and 11 show print platen motor control circuitry of the present invention.

The pin-printer drivers 173 as shown in FIG. 9 comprise nine switches or drivers, and supression diodes as are well known in the art.

Figure 10:
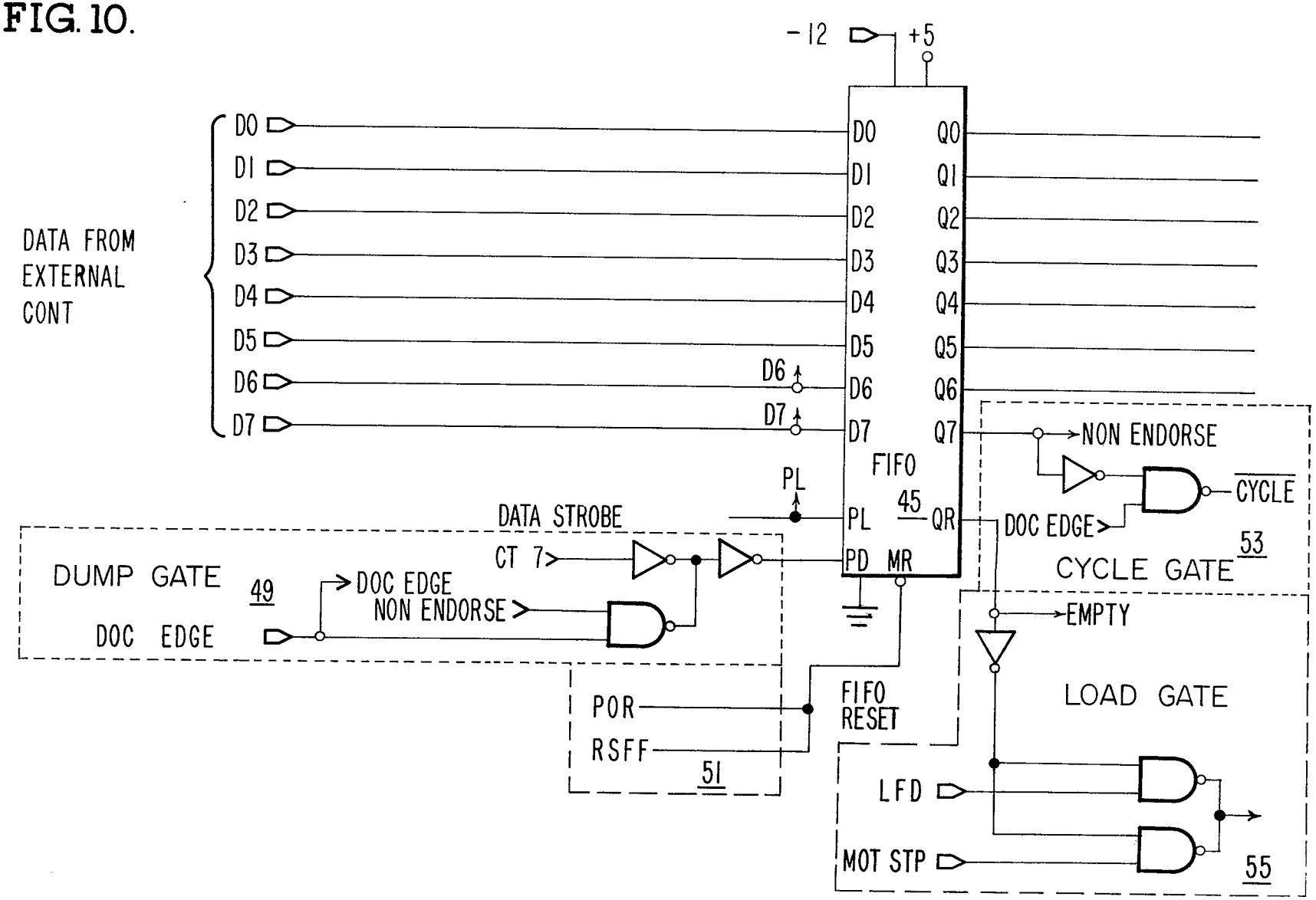

Referring to FIG. 10, the FIFO dump gate 49 is a logic circuitry for generating a dump pulse to shift a new character address from the FIFO 45 to the ROM 43 after the scan counter 57 has counted through its seven consecutive scan addresses. Thus, the simplest circuitry for dump gate 49 would include the application of the CT>7 signal to the FIFO dump node. Also, when an operator desires not to endorse a moving document, a non-endorse mode may be selected which a NON-ENDORSE signal is generated by the controller and fed to the dump gate 49 for generation of a dump signal to empty the FIFO 45. The non-endorse signal may also be inputted to cycle gate 53 to disable the drive motor 35 from rotation in response to the document sensor 52.

The FIFO 45 is loaded prior to each document endorsement by the external controller generating a data strobing signal to load a maximum of 31 words into the FIFO. Each word is the ROM binary address for one character. Each word in the FIFO is dumped by dump gate 49 once after each character is printed until the FIFO is empty.

The FIFO reset 51 as illustrated in FIG. 10 generates a FIFO reset signal for resetting the FIFO preparing the same to receive a message endorsement data block from the external controller. Thus, it is necessary that the reset 51 determine the completion of each document endorsement for resetting the FIFO. The reset may determine when the document endorsement has been completed by a number of ways including feeding the FIFO with an RSFF signal decoded from the LFD counter (FIG. 6) indicating that the disk 67 has rotated past the print commands.

The load gate 55 as illustrated in FIG. 10 is utilized to signal the external controller that the FIFO has been reset and is ready to accept a subsequent block of message data from the external controller. The load gate 55 may generate a signal from an EMPTY signal generated by the FIFO, NANDed with the LFD signal, or the EMPTY signal NANDed with the MOTOR STOP signal. The load gate 55 may maintain a constant signal output to the external controller until the message data begins entering the FIFO 45 extinguishing the EMPTY signal.

Figure 12:
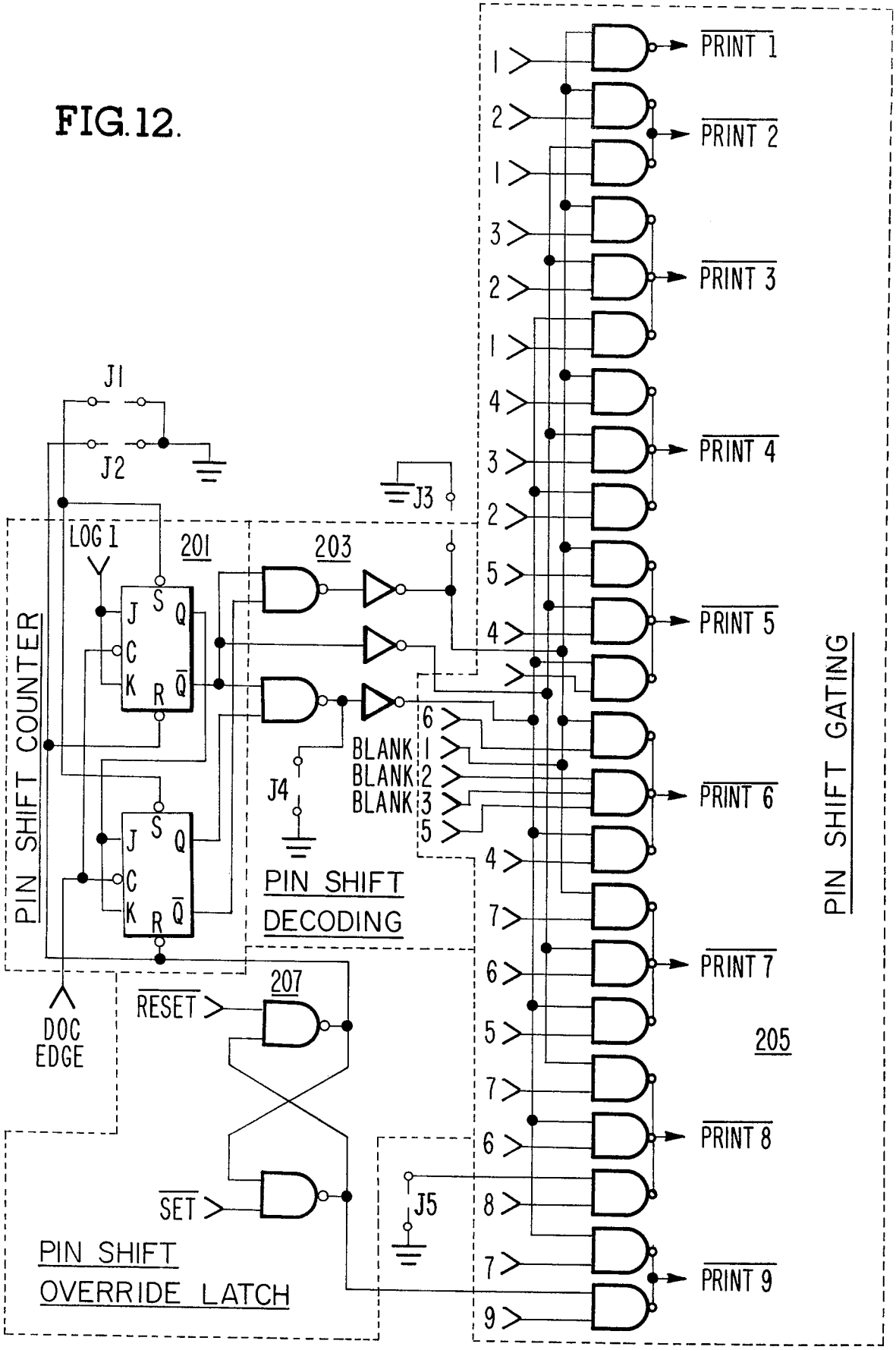
FIG. 12 shows a schematic diagram of a pin shifting system of the present invention.

Referring to FIG. 12, pin shifting logic may be incorporated for improving the pin printer life as disclosed in the above crossed reference application U.S. Ser. No. 643,366 and incorporated herein by reference. The circuitry of FIG. 12 will distribute the wear of the more frequently used pins and increase time of print pin replacement significantly.

The circuitry of FIG. 12 automatically selects one of three sets of seven pins each time a new document is to be endorsed. The three sets include: a first set of pins 1–7, a second set of pins 2–8, a third set of pins 3–9. The logic can be locked at any one of these three sets by electrically fixing one set into constant operation. This provides use of the printer in the event that a driver pin should fail. By forcing the selection of a set of pins that is still working properly, the system may be used until service is available.

The output of a two-bit counter 201 is utilized to shift pin selection between the three sets. The counter 201 is incremented once for each document by clocking the counter with the DOC EDGE signal.

The counter outputs are decoded via pin shift decoding circuitry 203 for generating either a first, second or third shift signal. These signals are then used to gate the appropriate ROM outputs to the proper pin set via pin shift gating circuit 205.

The pin shift decoding circuitry 203 decodes the four counts from pin shift counter 201 such that a counter output of 00 selects the first set, 01 selects the second set, 10 selects the third set and 11 selects the second set. The second set is used twice during each cycle of the counter to provide better distribution of wear.

When the pin shifting circuitry of FIG. 12 is utilized, the print blanking circuitry 169 (FIG. 8) is omitted and the output signals from NAND gate 177 of BLANK 1, BLANK 2 and BLANK 3 are fed to the appropriate inputs of the pin shifting gating circuitry 205 as illustrated in FIG. 12. When pin shifting is not utilized, the BLANK 2 signal of FIG. 8 is omitted and the outputs of the print blanking circuitry 169 are fed directly as a seven pin or nine pin output to the drivers 173 of FIG. 9.

Because a nine pin printer is capable of printing all the lower case alpha characters, the pin shift logic may be automatically disabled to permit enablement of all nine pins by utilizing a pin shift override latch 207 as shown in FIG. 12. The override latch 207 may be enabled when a lower case alpha character is addressed, by locking the shift logic in the first set and enabling pins 8 and 9 to provide enablement of all nine pins. The override latch may be then reset after printing of the selected lower case alpha character is completed.

The motor initiation circuitry 54 of FIG. 2 is utilized in conjunction with a solid-state relay 59 (FIG. 9) for triggering the motor 35 in response to the sensing of an entering document by the document sensor 52. The platen motor 35 as shown in FIG. 9 is driven by an AC line input at 36. The solid-state relay 59 is operable for connecting the AC input at 36 along line 38 with the input line 42 of the platen motor for rotating the same. The motor initiation circuitry 54 serves to control the actuation of the platen motor via relay 59 in proper phasing with the AC signal.

Figure 11:
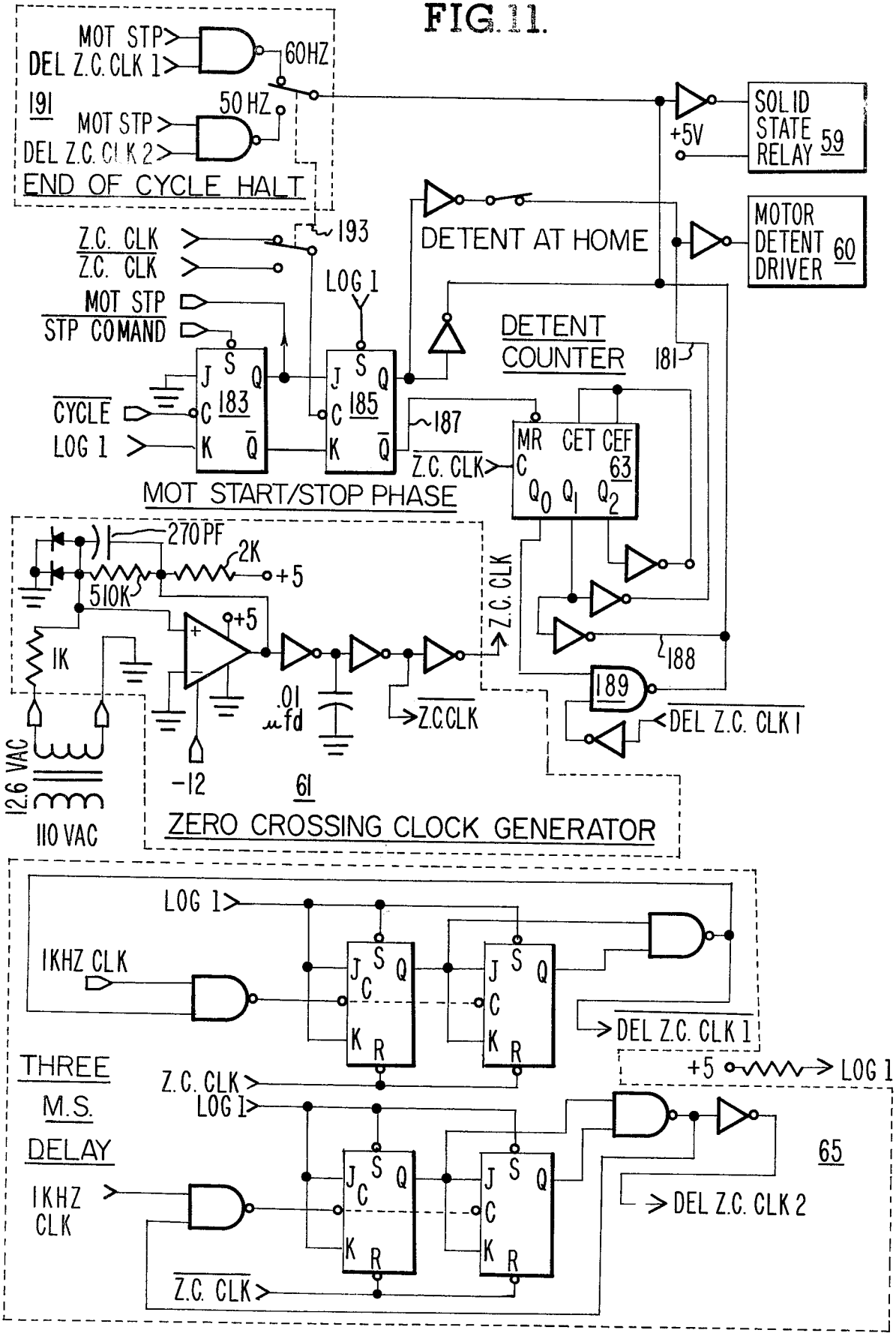

The motor initiation circuitry 54 is described in more detail in FIG. 11. The circuitry of FIG. 11 triggers the relay 59 for starting motor rotation when the AC cycle is at a zero voltage point and the voltage is increasing. The platen 27 is rotated 30° (using a 24 pole, 60 Hz. Motor) placing the peripheral area 40 of the velocity control element 41 into the guideway. The circuitry of FIG. 11 then disables the motor after the 30° rotation has occurred, thereby stopping the document or hindering its travel through the guideway via the velocity control element 41. The circuitry then restarts the motor rotating the platen for the remaining 330° of its rotation after which it is again stopped at its HOME position, ending the endorsing operation.

In order to provide a proper phasing relationship with respect to the AC cycle during each turn-on and turn-off occurrence of the motor, a zero-crossing clock generator 61 (FIG. 11) is utilized to generate pulses in phase with the AC signal. The clock generator 61 includes a comparator circuit that switches polarity every time the AC line crosses zero voltage, as is well known in the art.

The zero-crossing clock generator 61 produce an output signal, Z.C.CLK, which is shown in FIG. 5A as a square wave signal set in phase with the AC signal.

As shown by the MOTOR ON waveform of FIG. 5A, the motor 35 is turned on for a 30° rotation then switched off for two AC cycles permitting interception of the document by the velocity control element 41, and then switched back on for the remaining 330° rotation to execute printing on the intercepted document.

In order to determine that a 30° motor rotation has occurred, a detent counter 63, shown in FIG. 11, receives the Z.C.CLK signal as an input for counting corresponding to the number of AC cycles. Two AC cycles corresponds to a 30° rotation for a 60 Hz. motor. Thus, after a count of two by the detent counter 63 the motor is turned off. The motor is then kept off for two more AC cycles, i.e., until the detent counter has counted to four, afterwhich the motor is turned back on.

The detent counter outputs Q0, and Q1 and Q2 are utilized to properly control the turn-off time of the motor 35 for the two AC cycle pause. As shown in FIG. 5A, the Q1 output will be high during the desired motor off-time. Thus, a detent signal is taken from the Q1 output of the counter 63 (FIG. 11) and fed along line 181 to a motor detent driver 60, shown in more detail in FIG. 9. The motor detent driver 60 turns on the detent coil 64 of the motor 35 for stopping the same during a high output from the Q1 node of the detent counter 63. As shown in FIG. 5A, the ENERGIZED MOTOR DETENT signal represents the signal applied to the motor detent driver 60, shown as a pulse occurring during the Q1 output of the detent counter 63.

The Q2 node of the detent counter is utilized to reset the counter, preparing itself for the next document interception.

The signal which is fed to the solid-state relay for connecting the AC line 36 to the motor 35 is illustrated in FIG. 5A being denominated "SIGNAL TO SOLID-STATE RELAY". As shown in FIG. 5A, it is desired that the solid-state relay be turned off in advance of the motor detent driver's initiation for assuring that the relay will be shut off at the correct zero current point in the event of any phase shift between the motor current and the Z.C.CLK, signal. Also the signal to the relay is desired to be turned off early at the completion of document endorsement.

In order to provide the early turn off of the solid-state relay 59, two counters 65 (FIG. 11) are utilized to generate delay Z.C.CLK signals. The two counters at 65 utilize a one kilohertz clock signal in conjunction with the Z.C.CLK signal for producing a DEL Z.C.CLK 1 signal and a DEL Z.C.CLK 2 signal, the waveforms of which are shown in FIG. 5A.

Referring again to FIG. 11, a motor start/stop flip-flop 183 is utilized to set up a triggering of the solid-state relay 59 at the beginning of each endorsement The signal CYCLE outputted from the document sensor 52 via cycle gate 53 sets the flip-flop 183 for a starting of the endorsing operation via a phase flip-flop 185. The flip-flop 183 is reset by the STOP COMMAND signal when the disk has rotated into the 5° sector 147 as previously described.

The phase flip-flop 185 is utilized for energizing the motor solid-state relay 59. The output of the motor start/stop flip-flop 183 is fed to the phase flip-flop 185 for preparing the flip-flop 185 to be initiated by the trailing edge of the Z.C.CLK signal. Referring to FIG. 5A, a signal denominated "CYCLE F.F." represents the output of flip-flop 185. The RUN FLIP-FLOP signal of FIG. 5A goes high to trigger the solid-state relay 59 upon the trailing edge of the Z.C.CLK signal immediately occurring after the cycle flip-flop has been set high. This triggers the solid-state relay at the appropriate zero-crossing point of the AC cycle input to motor 35.

With phase flip-flop 185 set, the detent counter 63 is enabled along line 187 for permitting the counter to begin counting according to the Z.C.CLK signal.

The requirement of an early turn-off of the solid-state relay as previously described is performed by an early count from the output Q0 of the detent counter 63 NANDed with the DEL Z.C.CLK 1 signal via NAND gate 189 to assure proper turn-off of the relay by the zero current time. The Q1 output of the detent counter 63 is also fed to the solid state relay 59 via line 188 to keep the motor off for the two cycles.

An END OF CYCLE HALT circuit 191 is utilized to remove the signal from the relay just prior to the zero current point at the end of the endorse operation. The MOTOR STOP signal is NANDed with the DEL. Z.C.CLK 1 signal to remove the signal from the relay 59.

The motor initiation circuitry of FIG. 11 has been described with respect to the use of a 60 Hz motor as the motor 35. However, the use of a 20 pole, 50 Hz motor is also compatible with the circuitry by changing the circuitry in the END OF CYCLE HALT circuit 191 and changing the clock input of phase flip-flop 185. This change is illustrated by operation of a switch 193. The END OF CYCLE HALT circuitry 191 changes operation for turning the relay 59 off in response to the output of the MOTOR STOP signal NANDed with the DEL Z.C.CLK 2 signal, and the input of the phase flip-flop 185 becomes the Z.C.CLK signal inverted.

It should be understood, of course, that the foregoing disclosure relates to preferred embodiments of the invention and that other modifications or alterations may be made therein without departing from the spirit or scope of the invention as set forth in the appended claims.

What is claimed is:

1. Apparatus for printing characters onto a moving document traveling past a matrix pin printer in which each character is formed by a plurality of closely spaced columns of dot patterns and with spacing time occurring between the printing of characters, comprising:

first means for generating a plurality of successive signal commands;

second means cooperating with said first means, for printing a single column of dot patterns by a matrix pin printer responsive to generation of a said signal command;

third means for delaying printing of a single column of dot patterns by said second means, said third means responsive to a said generation of a said signal command which occurs prior to completion of an earlier said printing of a single column of dot patterns, said third means delaying until after said printing of a single column of dot patterns is completed; and fourth means responsive to said spacing time between printing of entire characters for disabling said second means from responding to a said generated signal command.

2. Apparatus for printing characters onto a moving document traveling past a matrix pin printer in which each character is formed by a plurality of closely spaced columns of dot patterns and with spacing time occurring between the printing of characters, comprising:

first means for transducing the position of a moving document into successive signal commands;

second means cooperating with said first means for printing a single column of dot patterns by a matrix pin printer responsive to a said signal command;

third means for delaying printing of a single column of dot patterns by said second means, responsive to a said signal command occurring during a said printing of a single column of dot patterns until after said printing of a single column of dot patterns is completed; and fourth means responsive to spacing time between printing of entire characters for disabling said second means from responding to a signal command.

3. Apparatus according to claim 2 wherein said second means fires the pins of the printer for a predetermined energization time; and said third means is responsive to a said signal command which occurs prior to completion of an earlier said predetermined energization time of a firing by said second means.

4. Apparatus according to claim 3 wherein said third means delays printing of a single column of dot patterns by said second means until a predetermined delay time after said energization time is completed.

5. Apparatus according to claim 1 and further including:

means for counting according to said successive signal commands; and wherein said second means is responsive to individual predetermined counts of said counting means for a said printing of a single column of dot patterns and wherein said fourth means is responsive to other of said counts corresponding to spacing between printing of characters for a said disabling of said second means.

6. Apparatus according to claim 5 and further including:

a selectably energizable dot matrix printer having a plurality of pins arranged for printing columns of dot patterns;

storage means for receiving quantums of data information, each said quantum representative of a printable character;

means for converting a said quantum of data information into a plurality of successive print commands, said plurality of print commands for successively energizing said printer for printing successive printings of single columns of dot patterns forming the character represented by said quantum, said converting means cooperating with said counting means for generating a said print command responsive to each of said predetermined counts;

means responsive to at least one predetermined count of said counting means for successively dumping said storage means of said information quantums into said converting means; and means directing said successive print commands to said printer for selective energization thereof.

* * * * *